US011566497B2

(12) United States Patent
Su et al.

(10) Patent No.: US 11,566,497 B2
(45) Date of Patent: Jan. 31, 2023

(54) MODULAR ANTI-ROTATION DRILLING SYSTEMS AND METHODS

(71) Applicant: National Technology & Engineering Solutions of Sandia, LLC, Albuquerque, NM (US)

(72) Inventors: Jiann-Cherng Su, Albuquerque, NM (US); Stephen Buerger, Albuquerque, NM (US); Anirban Mazumdar, Atlanta, GA (US); Adam Foris, Albuquerque, NM (US)

(73) Assignee: National Technology & Engineering Solutions of Sandia, LLC, Albuquerque, NM (US)

( * ) Notice: Subject to any disclaimer, the term of this patent is extended or adjusted under 35 U.S.C. 154(b) by 0 days.

(21) Appl. No.: 17/412,397

(22) Filed: Aug. 26, 2021

(65) Prior Publication Data

US 2021/0388697 A1 Dec. 16, 2021

Related U.S. Application Data

(62) Division of application No. 15/809,639, filed on Nov. 10, 2017, now Pat. No. 11,131,167.

(51) Int. Cl.
*E21B 43/10* (2006.01)
*E21B 17/02* (2006.01)
(Continued)

(52) U.S. Cl.
CPC ..... *E21B 43/106* (2013.01); *E21B 4/006* (2013.01); *E21B 4/18* (2013.01); *E21B 17/02* (2013.01);
(Continued)

(58) Field of Classification Search
CPC ..... E21B 17/02; E21B 7/1057; E21B 7/1064; E21B 7/10; E21B 7/1014; E21B 7/1021;
(Continued)

(56) References Cited

U.S. PATENT DOCUMENTS 1,898,074 A 2/1933 Bailey
3,443,648 A 5/1969 Howard
(Continued)

FOREIGN PATENT DOCUMENTS

WO 97/01693 A1 1/1997

OTHER PUBLICATIONS

Billingham, M., El-Toukhy, A.M., Hashem, M.K., Hassaan, M., Sheiretov, M.L.T., Loth, M.; Conveyance—Down and Out in the Oil Field; Oilfield Review; Summer, 2011; 18-31; 23, No. 2.
(Continued)

*Primary Examiner* — George S Gray
(74) *Attorney, Agent, or Firm* — Daniel J. Jenkins

(57) ABSTRACT

A modular anti-rotation device for preventing rotation with respect to the central axis of a drilling tool in a borehole and for producing a notch in a borehole surface. The anti-rotation device includes an upper fixture portion and a lower fixture portion in axial alignment. The upper fixture portion and the lower fixture portion are connected by yoke assemblies. Each yoke assembly is connected to the fixture portion and fixture portion at one end, and forming an articulated joint of the upper yoke assembly and the lower yoke assembly at a distal end opposite the first end. A roller is connected at each joint, connecting the upper and lower yoke assemblies. The rollers engage vertically with a borehole surface, the rollers travelling axially, as a drill shaft penetrates into the borehole, the rollers simultaneously preventing radial movement of the anti-rotation device and prevent rotation with respect to the central axis of the borehole.

16 Claims, 5 Drawing Sheets

(51) Int. Cl.
*E21B 4/18* (2006.01)
*E21B 17/10* (2006.01)
*E21B 4/00* (2006.01)

(52) U.S. Cl.
CPC ..... *E21B 17/1021* (2013.01); *E21B 17/1057* (2013.01); *E21B 17/1078* (2013.01); *E21B 17/10* (2013.01)

(58) Field of Classification Search
CPC ..... E21B 7/1078; E21B 7/00; E21B 7/006; E21B 43/106; E21B 4/18; E21B 17/041; E21B 4/006
See application file for complete search history.

(56) References Cited

U.S. PATENT DOCUMENTS 3,568,053 A * 3/1971 Kilpatrick ..... E21B 17/1021 324/722
10,385,616 B1 8/2019 Su
2006/0157278 A1 7/2006 Dolgin et al.
2014/0174760 A1 6/2014 Slocum et al.

OTHER PUBLICATIONS

Leising, L.J., Onyia, E.C., Townsend, S.C., Paslay, P.R., Stein, D.A.; Extending the Reach of Coiled Tubing Drilling (Thrusters, Equalizers and Tractors); SPE/IADC Drilling Conference; Mar. 1997; 677-690; Amsterdam, The Netherlands.
Parness, A., Frost, M., Thatte, N., King, J.P.; Gravity-Independent Mobility and Drilling on Natural Rock Using Microspines; 2012 IEEE International Conference on Robotics and Automation; May 14-18, 2012; 3437-3442; 978-1-4673-1405-3/12; Saint Paul, Minnesota.
Noui-Mehidi, M.N., Saeed, A.S., Al-Khamees, H., Farouk, M.; Development and Field Trial of the Well-Lateral-Intervention Tool; SPE Production & Operations; May 2016; 157-162.
Payne, M.L., Abbassian, F.; Advanced Torque-and-Drag Considerations in Extended-Reach Wells; SPE Drilling & Completion; Mar. 1997; 55-62.

* cited by examiner

N UNITS $$F_{out} = F_{in}\left(1 - \frac{\mu_A}{\tan\theta}\right)^N$$

$$F_{f,\tau} = \sum_{i=1}^{N} \frac{\mu_\tau F_{in}}{\tan\theta}\left(1-\mu_A\right)^{i-1}$$

MODULAR ANTI-ROTATION DRILLING SYSTEMS AND METHODS

CROSS-REFERENCE TO RELATED APPLICATIONS

This is a divisional of U.S. patent application Ser. No. 15/809,639, which was filed on Nov. 10, 2017, entitled "MODULAR ANTI-ROTATION DRILLING SYSTEMS AND METHODS", which is hereby incorporated herein by reference in its entirety.

STATEMENT REGARDING FEDERALLY SPONSORED RESEARCH OR DEVELOPMENT

This invention was developed under Contract No. DE-NA0003525 awarded by the United States Department of Energy/National Nuclear Security Administration. The Government has certain rights in this invention.

BACKGROUND OF THE INVENTION

The application generally relates to drilling. The application relates more specifically to anti-rotation means for modular drilling systems.

Drilling dysfunction is a major cause of slower drilling rates, damaged hardware, and increased drilling costs. Drilling dysfunction may result from drill string twist and the inability of the drilling assembly to manage the load, or weight-on-bit that is applied at the drill bit. This problem is more likely to occur when drilling long distances, with smaller drill pipe, or when rotation is generated downhole. Downhole rotation is generated downhole, e.g., when drilling with a positive displacement motor (PDM) or turbine.

What is needed is a system and/or method that satisfies one or more of these needs or provides other advantageous features. Other features and advantages will be made apparent from the present specification. The teachings disclosed extend to those embodiments that fall within the scope of the claims, regardless of whether they accomplish one or more of the aforementioned needs.

SUMMARY OF THE INVENTION

One embodiment relates to a modular anti-rotation device for preventing rotation with respect to the central axis of a drilling tool in a borehole. The modular anti-rotation device includes an upper fixture portion and a lower fixture portion disposed opposite the upper fixture portion in axial alignment. The upper fixture portion and the lower fixture portion are connected by multiple yoke assemblies. Each yoke assembly is connected to the upper fixture portion and lower fixture portion at one end, and forming an articulated joint of the upper yoke assembly and the lower yoke assembly at a distal end opposite the first end. A roller is connected at each joint, connecting the upper and lower yoke assemblies. The rollers are in rolling engagement vertically with a borehole surface, the rollers moveable to travel in an axial direction, as a drill shaft attached to the modular anti-rotation device penetrates into the borehole, the rollers simultaneously preventing radial movement of the anti-rotation device and prevent rotation with respect to the central axis of the borehole.

Another embodiment relates to a modular anti-rotation device with a locked wheel or gear against vertical and radial movement of the device. The modular anti-rotation device includes an upper fixture portion and a lower fixture portion disposed opposite the upper fixture portion in axial alignment. The upper fixture portion and the lower fixture portion are connected by multiple yoke assemblies. A gear is attached to the yoke assembly. The gear has a notch for receiving a locking member on the yoke assembly for locking the gear against rotation. The gears are in locking engagement vertically with a borehole surface, as a drill shaft attached to the modular anti-rotation device penetrates into the borehole.

A further embodiment relates to a method for drilling a borehole in an earth surface formation. The method includes providing one or more modular anti-rotation devices in series with a mechanical drilling tool; directly modulating a process weight-on-bit with minimal losses to friction in the axial direction by modulating an input force Fin from the top of the borehole; mounting a heavy drill pipe to a top fixture of the modular anti-rotation device; suspending the heavy drill pipe from above the borehole; and changing the tension in the cable by modulating Fin.

An additional embodiment relates to a method for notching a borehole in an earth surface formation. The method includes replacing the roller elements with diamond-shaped (or sharpened wheels) cuttings inserts. The cutting inserts engage the borehole in the same manner as the rollers mentioned previously. However due to the sharpened point on the cutter, a notch (or any feature that causes large friction between the two elements) is produced in the borehole when rotation is applied.

One aspect of the invention is a device that allows the weight-on-bit required for drilling to be applied while also managing the drill string twist that leads to drilling dysfunctions such as stick-slip.

Another aspect is a mechanical linkage configured to apply force that is proportional to the weight-on-bit on the borehole surface 30 while transmitting axial loads used to generate weight-on-bit.

Still another advantage is that coulomb friction at this interface allows torque to be reacted without any rotation of the modular device or the drill string above the modular device. This reaction torque limit is proportional to the applied weight-on-bit.

A further advantage is that the device is able to adapt to and function in different borehole sizes because the links automatically expand under load until they contact the borehole wall.

Alternative exemplary embodiments relate to other features and combinations of features as may be generally recited in the claims.

BRIEF DESCRIPTION OF THE DRAWINGS

The application will become more fully understood from the following detailed description, taken in conjunction with the accompanying figures, wherein like reference numerals refer to like elements, in which.

DETAILED DESCRIPTION OF THE INVENTION

Before turning to the figures which illustrate the exemplary embodiments in detail, it should be understood that the application is not limited to the details or methodology set forth in the following description or illustrated in the figures. It should also be understood that the phraseology and terminology employed herein is for the purpose of description only and should not be regarded as limiting.

Figure 1:
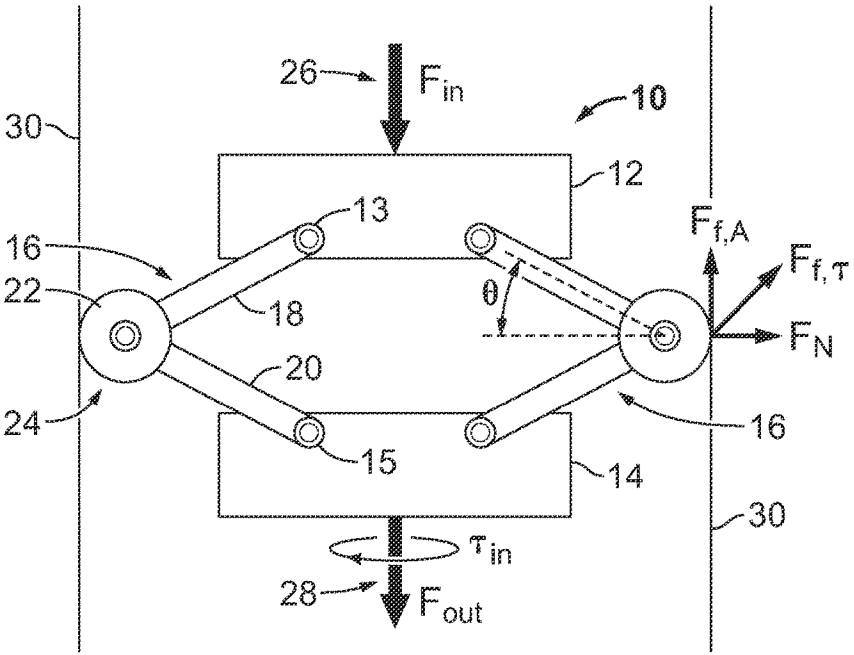
FIG. 1 shows a schematic diagram of a modular device of the present invention.
Figure 2:
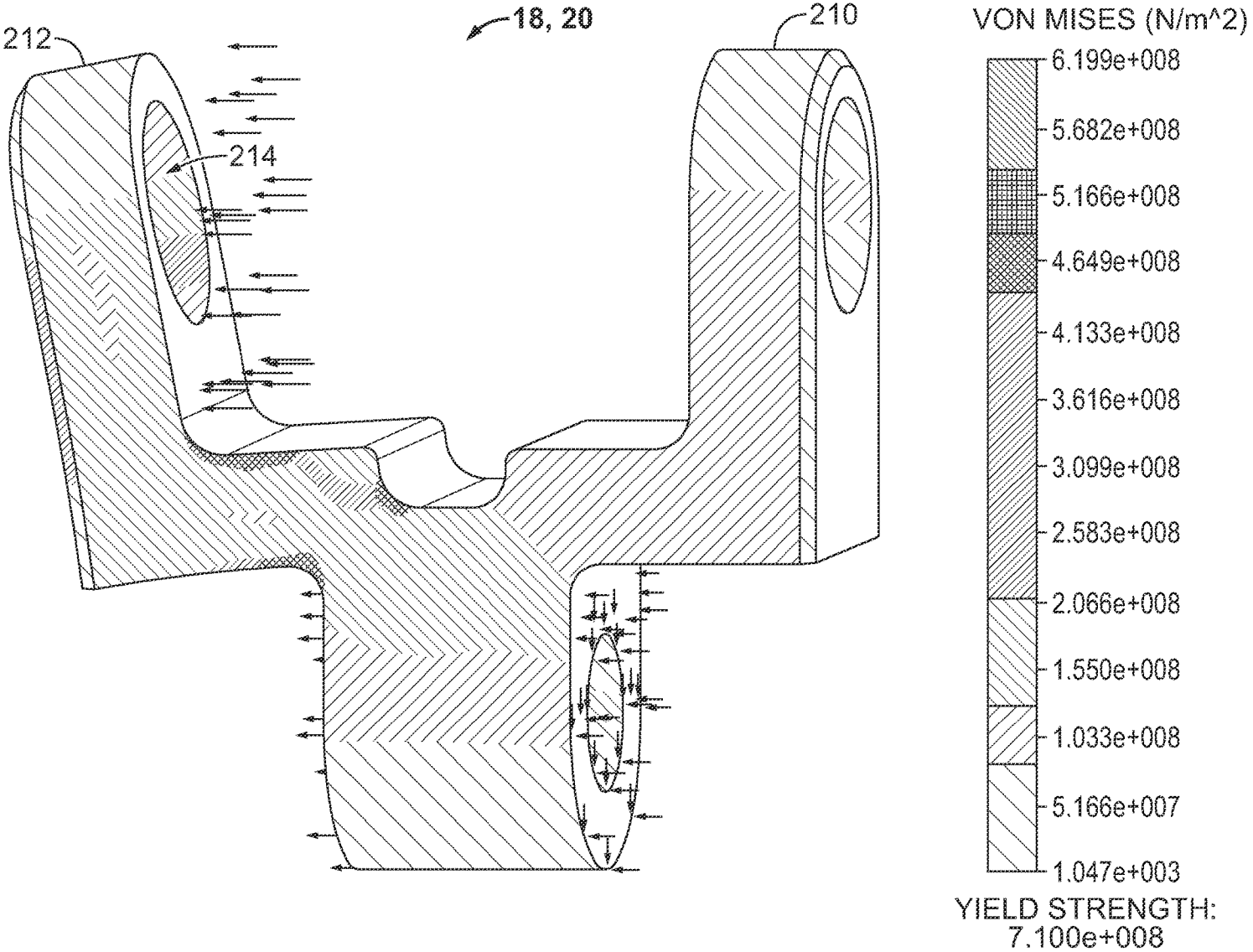
FIG. 2 shows a yoke assembly portion of the modular device of FIG. 1.

Referring to FIG. 1, a schematic diagram of a modular anti-rotation device, generally designated as 10, is shown. Modular anti-rotation device 10 comprises a pair of round fixture portions, including an upper mount fixture 12 and a lower mount fixture 14. Upper mount fixture 12 and lower mount fixture 14 are disposed opposite one another in axial alignment and are connected by two or more yoke assemblies 16. Each yoke assembly 16 includes an upper yoke assembly 18 having an opposing pair of yoke arms 210, 212 (see, e.g., FIG. 2) and a lower yoke assembly 20 having an opposing pair of yoke arms 210, 212. Arms 210, 212 are spaced on respective yoke assemblies 18, 20 so as to be configured in overlapping relation at one end 24, e.g., by a cross bolt (not shown) traversing yoke arms through respective yoke opening 214 aligned coaxially for insertion of the cross bolt.

The cross-bolt also traverses a roller 22 disposed between yoke arms 210, 212 in rotational relationship radially on the cross bolt to allow axial displacement in a vertical direction in a drill borehole 26 as a drill shaft 28 penetrates downwardly in rock or other material to extend the borehole 26. Rollers 22 engage borehole surface 30 and travel downward, or in an axial direction, as drill shaft 28 penetrates further into the borehole 26. Rollers 22 may include teeth, or other features that increase friction between the rollers 22 and the borehole surface 30, e.g., a sawtooth profile, along the peripheral edge for engaging borehole surface 30, to prevent radial rotation of modular device 10 within borehole 26 while allowing easy vertical displacement with borehole 26.

Yoke assemblies 18, 20 are fastened at opposite ends from roller 22 at attachment points 13, 15, on inner surfaces of upper mount fixture 12 and lower mount fixture 14, respectively, to form a linkage between upper mount fixture 12 and lower mount fixture 14.

Modular device 10 utilizes applied axial load from above, referred to as weight-on-bit (WOB) to generate forces against borehole surface 30. The radial forces are transmitted via yoke assemblies, or links, 16 which are attached to upper mount fixture 12 and lower mount fixture 14. The lateral or radial force transmitted to borehole surface 30 is determined by the magnitude of the WOB, the geometry of yoke assemblies 16 and the diameter of borehole 26. Radial forces are amplified or attenuated at borehole surface 30 in response to the controlled mechanical advantage imparted by yoke assemblies 16. Specifically, if the modular device 10 is implemented with rigid links and pin joints, the radial force, or normal force, $F_N$, on the borehole surface 30 is proportional to the inverse of the tangent of the angle θ, as shown in Equation 1 below:

$$F_N = \frac{F_{in}}{\tan\theta} \qquad \text{EQ. 1}$$

By shortening the link lengths or moving their pivot points closer to modular device 10 centerline, angle θ is reduced, and $F_N$ is increased. If θ<45°, then $F_N > F_{in}$ in theory, where $F_{in}$ is the downward, or input, force. Rollers 22 allow modular device 10 to move axially, with minimal loss to friction, while reacting torsion due to torque generated by a downhole motor or other device to perform drilling. The size, diameter and profile, or contact area, influence the performance of modular device 10. A downhole motor mounted below modular device 10 applies the torque required for drilling. Modular device 10 also provides a conduit to allow drilling mud or other cutting fluids to be circulated through the borehole during drilling. Multiple units of modular device 10 may be connected, or stacked, axially to react more torque as necessary based on the drilling requirements and the output of the motor. The tool can be used in a variety of formations and can be tailored for various rotation reaction loads.

Modular device 10 includes novel features that are central to its novelty, function, and benefits. The reaction torque limit of modular device 10 is proportional to the applied weight-on-bit. In drilling, the process torque for effective drilling generally increases with applied weight-on-bit. In this device, because $F_N$ is proportional to $F_{in}$, as indicated above, the reaction torque limit automatically increases with weight-on-bit. Any torque below the reaction torque limit may be accommodated without rotary slip.

The relationship between radial force and weight-on-bit can advantageously be tuned using device parameters to achieve design criteria. E.g., the link lengths and joint locations may be modified, or adjusted, to modify the mechanical advantage provided by modular device 10 to increase or decrease the normal force $F_N$ applied against wall surface 30 and the associated friction.

Further, friction may be made asymmetric, e.g. by using rolling elements 22, to enable large reaction torques and transmission of weight on bit. In one embodiment, it may be desirable to directly modulate the process weight-on-bit by modulating $F_{in}$ from the top of the hole. In one exemplary embodiment, a section of heavy drill pipe may be mounted to the top fixture 12 of modular device 10 and suspended by a cable (not shown) from the top of the hole. $F_{in}$ may be thus modulated by changing the tension in the cable. In this case, it is desired for $F_{out}$ to approach $F_{in}$, i.e. for as much of the weight as possible to be transmitted through modular device 10. Thus, a low friction force F may be preferred.

Force vectors are represented in FIG. 1, indicating as follows;

$$\text{Output force: } F_{out} = F_{in} - \mu_A \frac{F_{in}}{\tan\theta} \qquad \text{Eq. 2}$$

$$\text{Torque/Force: } F_{f,\tau} = \mu_\tau F_N \qquad \text{Eq. 3}$$

$$\text{Vertical friction: } F_{f,A} = \mu_A F_N \qquad \text{Eq. 4}$$

$$\text{wherein Torque in is: } F_{F,\tau} r_{hole} \geq \tau_{in} \qquad \text{Eq. 5}$$

μ_A is defined as the effective coefficient of friction (e.g. rolling friction) between the rollers and the borehole surface in the axial direction. μ_tau is the effective coefficient of friction (e.g. sliding friction) between the rollers and the borehole surface in the rotary/tangential direction. F_f,tau is in the tangential/"rotation" direction.

However, a high friction force $F_{f,\tau}$ may be desired in order to react torque. This may be accomplished by using wheels or rollers designed to roll along the borehole wall, producing very low friction in the vertical direction of rolling, and much higher friction in the normal direction of rotation which requires sliding movement perpendicular to the preferential rolling direction of the wheels.

Figure 3:
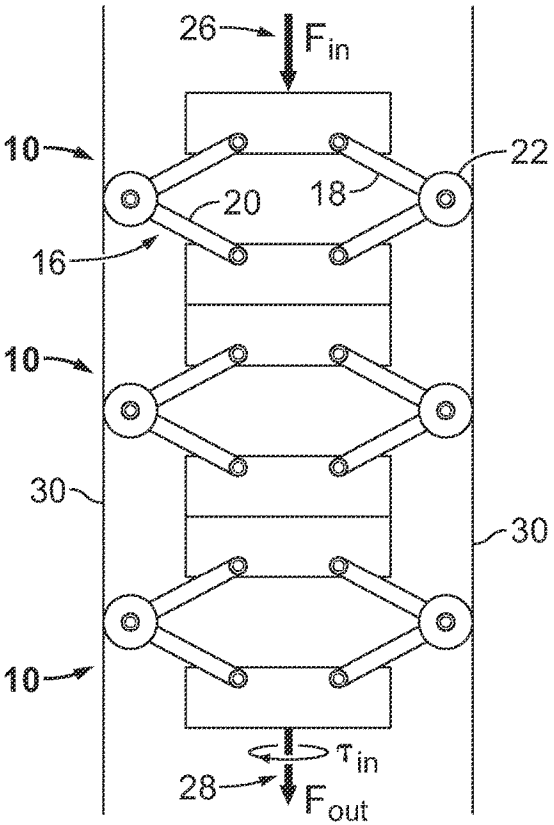
FIG. 3 shows an embodiment of multiple copies of modular device may be arranged in series in a borehole.
Figure 6:
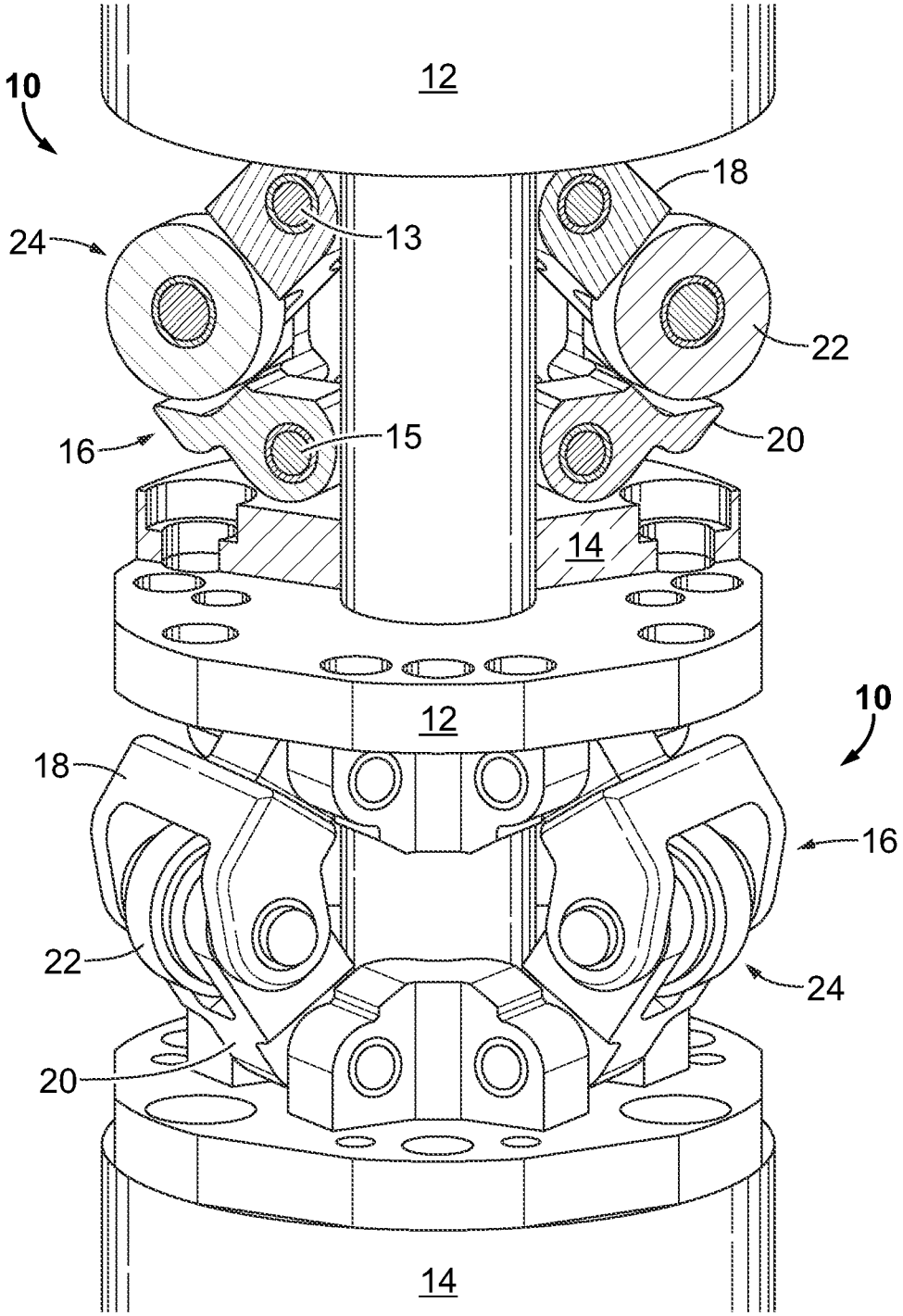
FIG. 6 shows a perspective view of the modular device of FIGS. 1 and 3.

Referring to FIG. 3 and FIG. 6, in another embodiment multiple copies of modular device 10 may be arranged in series in the borehole 26. Placing multiple copies of modular device 10 in series provides favorable scaling. The maximum reaction torque of a single modular device 10 is limited by the applied weight-on-bit, the geometry of the device, the angle θ, and the coefficient of friction between the rollers and the borehole surface 30 in the circumferential/rotary direction. There are practical limits to θ, and the coefficient of friction depends on material properties, tool wear, and other factors that are difficult to control. It is also inconvenient and expensive to use large weights. One way to increase the limiting torque without increasing weight is to stack additional tools in series, as shown in FIGS. 3 and 6.

The reaction torque provided by each module adds in parallel, such that the total reaction torque is the sum of the reaction torque from each module. If friction is low in the drilling direction, each module sees approximately the same axial force, with the only loss coming from friction in the preferred rolling direction. Therefore, the reaction torque limit can be increased dramatically with only a fractional increase in applied weight. Equations 6 and 7 below provide a mathematical description of the cumulative forces $F_{out}$ and $F_{f,\tau}$:

$$F_{out} = F_{in}\left(1 - \frac{\mu_A}{\tan\theta}\right)^N \quad \text{Eq. 6}$$

and $$F_{f,r} = \sum_{i=1}^{N} \frac{\mu_\tau F_{in}}{\tan\theta}(1 - \mu_A)^{i-1} \quad \text{Eq. 7}$$

Figure 5:
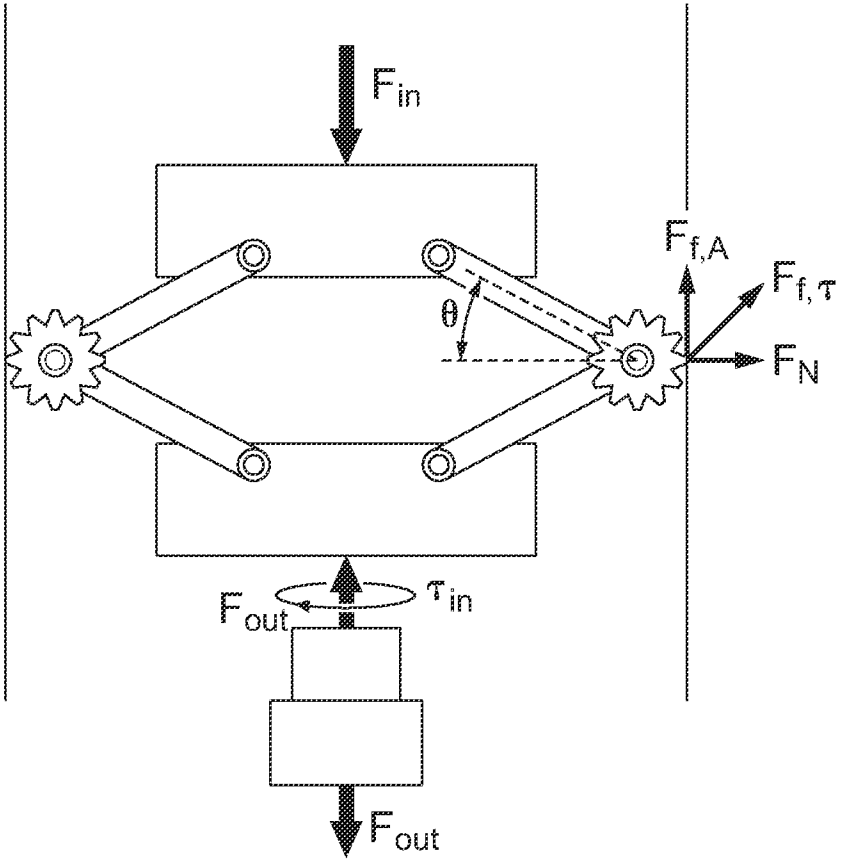
FIG. 5 shows a yoke assembly of FIG. 4 arranged to provide a vertical locking position for a modular device in a borehole.
Figure 4:
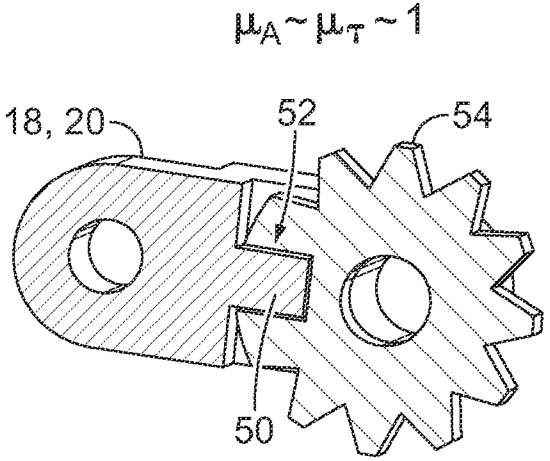
FIG. 4 shows an alternate embodiment of a yoke assembly with keyed interconnection for locking a wheel against rotation

Referring next to FIG. 4, an alternate embodiment of is shown of the yoke assembly 16 with keyed interconnection between the yoke portion and the toothed wheel to for locking the wheel against rotation. In the embodiment of FIG. 5, it may be desirable for the yoke assembly to provide a locking position vertically in borehole 26. A key portion 50 engages a slot 52 in gear 54 to interfere with rotation of gear 54. In this case, active weight-on-bit may be applied by another device, e.g. a hydraulic cylinder actuator, beneath modular device 10 in borehole 26. Modular device 10 reacts linear force as well as rotary torque. In this case, the device may be configured for maximum force amplification, i.e., minimum angle θ, and maximum friction in all directions, i.e., $\mu_A = \mu_\tau = 1$, where $\mu_A$ and $\mu_\tau$ are coefficients of friction, respectively. Rather than rollers, fixed gears 54 or other types of rollers with high-friction surfaces would be used to contact the borehole wall 30. This would potentially enable a minimal total downhole tool weight, as a very small weight could be used to lock the device and react much larger weights-on-bit and torque.

While the drawings disclose an embodiment having generally rigid links and pin joints, modular device 10 may be implemented in other ways as well. E.g., each two-link assembly may be implemented as a single flexural element to achieve a similar functionality in less expensive and possibly more robust package, and enable the effective angle θ to be selectively tailored and varied based on the position of modular device 10. Multiple contact geometries may also be used including, e.g., relatively sharp wheels that create line contact and dig into softer rock; with smooth roller surfaces whose radius matches the wellbore for a large contact area; and with knurled roller surfaces to create smaller regions of contact over a large area. Other variants may be used for particular tool/rock interfaces.

Figure 7:
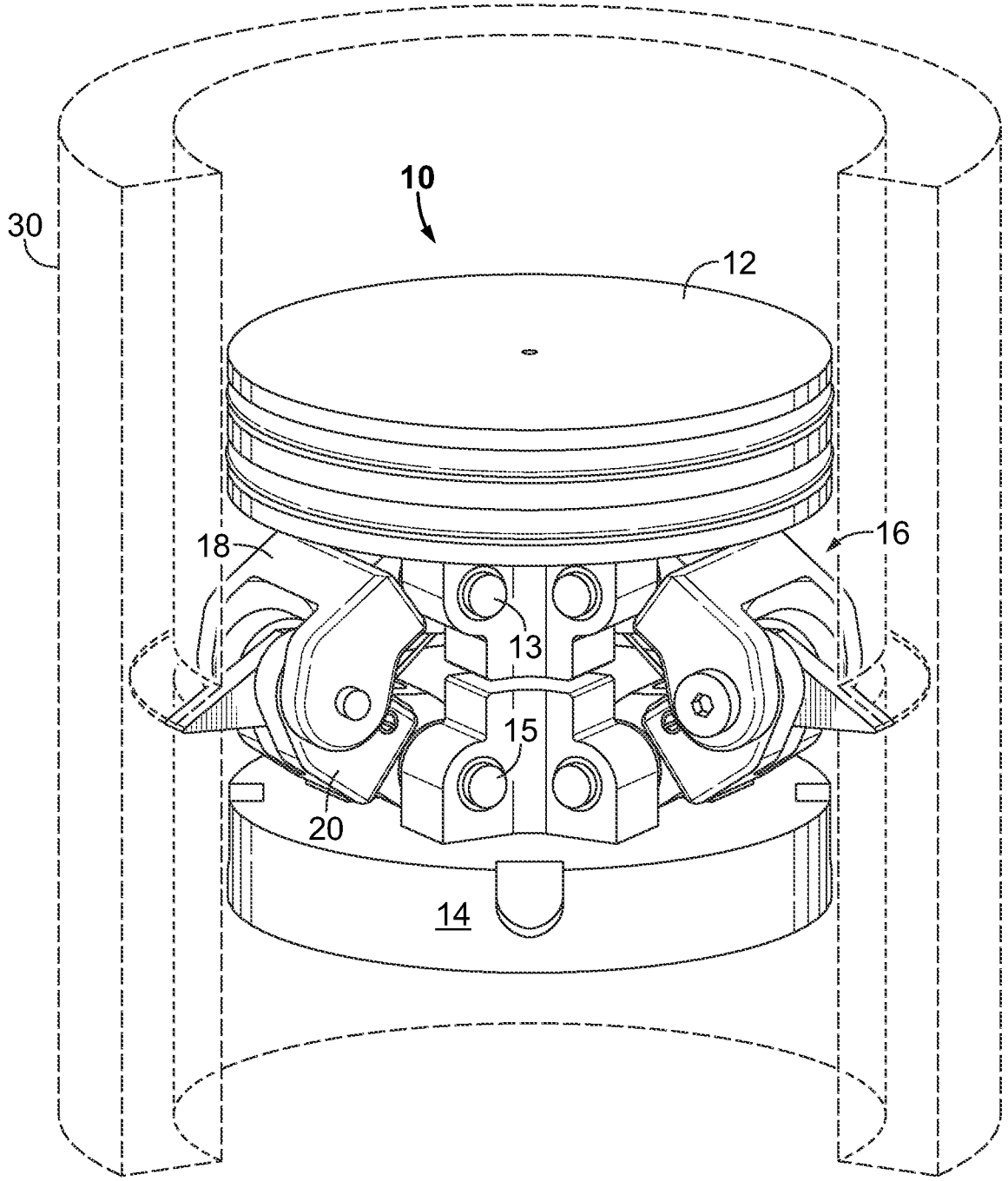
FIG. 7, shows another exemplary embodiment for modular device for notching a borehole in an earth surface formation.

Referring next to FIG. 7, in another exemplary embodiment an apparatus and method for notching a borehole in an earth surface formation is shown. The method includes replacing the roller elements 22 on modular device 10 with diamond-shaped or sharpened cutting inserts 23. The cutting inserts engage the borehole 30 in the same manner as rollers 22. Due to the sharpened point on inserts 23, a notch 25 (or similar feature configured to cause large friction between the two elements, is produced in borehole 30 when rotation is applied to modular device 10. In the embodiment of FIG. 7 modular device 10 may be used to insert a notch 25 in borehole 30 to induce stress concentrations necessary for controlled formation stimulation.

While the exemplary embodiments illustrated in the figures and described herein are presently preferred, it should be understood that these embodiments are offered by way of example only. Accordingly, the present application is not limited to a particular embodiment, but extends to various modifications that nevertheless fall within the scope of the appended claims. The order or sequence of any processes or method steps may be varied or re-sequenced according to alternative embodiments.

It is important to note that the construction and arrangement of the modular device as shown in the various exemplary embodiments is illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited in the claims. For example, elements shown as integrally formed may be constructed of multiple parts or elements, the position of elements may be reversed or otherwise varied, and the nature or number of discrete elements or positions may be altered or varied. Accordingly, all such modifications are intended to be included within the scope of the present application. The order or sequence of any process or method steps may be varied or re-sequenced according to alternative embodiments. In the claims, any means-plus-function clause is intended to cover the structures described herein as performing the recited function and not only structural equivalents but also equivalent structures. Other substitutions, modifications, changes and omissions may be made in the design, operating conditions and arrangement of the exemplary embodiments without departing from the scope of the present application.

The invention claimed is:

1. A modular device comprising:

an upper fixture and a lower fixture disposed opposite the upper fixture and in axial alignment therewith, the upper fixture attached to a drill pipe that applies vertical axial force upon the upper fixture to allow the upper fixture to move toward the lower fixture thereby decreasing the distance between the upper fixture and lower fixture;

the upper fixture and the lower fixture connected by at least two yoke assemblies;

each yoke assembly of the at least two yoke assemblies connected to the upper fixture portion and lower fixture portion at a first end, and forming an articulated joint of the upper yoke assembly and the lower yoke assembly at a distal end opposite the first end;

wherein each yoke assembly of the at least two yoke assemblies comprises an upper yoke assembly and a lower yoke assembly; and a cutting insert connected at each distal end of the upper and lower yoke assemblies and connecting the upper and lower yoke assemblies, the cutting insert movable in a radial direction with respect to the modular device in a borehole having a diameter.

2. The device of claim 1, wherein the upper yoke assembly comprises an opposing upper pair of yoke arms and an upper yoke leg connecting the upper yoke arms; and the lower yoke assembly comprises a lower pair of yoke arms and a lower yoke leg connecting the lower yoke arms.

3. The device of claim 2, wherein the opposing upper pair of yoke arms are spaced in overlapping relation with the lower pair of yoke arms and connected by a cross bolt traversing the upper and lower yoke arms through a respective yoke opening disposed in each arm of the upper yoke arms and the lower yoke arms; the respective openings aligned coaxially for receiving the cross bolt.

4. The device of claim 3, wherein the cutting insert is attached to the yoke assembly by the cross bolt.

5. The device of claim 1, wherein each yoke assembly is rotatably attached to the upper fixture portion and the lower fixture portion at a predetermined angle of incidence about a symmetrical axis of intersection of the cutting insert of each yoke assembly.

6. The device of claim 1, wherein the cutting insert is diamond shaped.

7. The device of claim 1, wherein the cutting insert produces a notch in the borehole when rotation is applied to the modular device.

8. The device of claim 1, wherein the vertical axial load generates radial forces against the borehole surface.

9. The device of claim 8, wherein the radial force transmitted to the borehole surface is dependent on a geometric relation of yoke assemblies and the diameter of the borehole.

10. The device of claim 8, wherein the radial forces are amplified or attenuated on the borehole surface in response to a controlled mechanical force imparted by the upper and lower yoke assemblies.

11. The device of claim 8, wherein a normal force $F_N$ applied against the borehole surface by the yoke assemblies is proportional to the inverse of the tangent of an angle θ.

12. The device of claim 11, wherein the normal force FN is defined by the equation:

$$F_N = \frac{F_{in}}{\tan\theta}$$

13. The device of claim 12, wherein each of the upper and lower yoke assemblies have a length and a joint location, the lengths and joint locations modifiable to tune mechanical properties of the modular anti-rotation device to increase or decrease the normal force $F_N$ applied against the borehole surface and the friction associated therewith.

14. A method for notching a borehole in an earth formation having a surface, the borehole comprising a top at the surface of the earth formation, comprising;

providing a modular device in series with a mechanical drilling tool;

directly modulating a process weight-on-bit applied to the modular anti-rotation device by modulating an input force F.sub.in from the top of the borehole onto a drill pipe mounted to a top fixture of the modular anti-rotation device so that the drill pipe applies the input force F.sub.in to the modular device;

suspending the drill pipe by a cable from above the borehole;

where changing the tension in the cable directly modulates the process weight-on-bit;

wherein the modular device comprises:

an upper fixture portion and a lower fixture portion disposed opposite the upper fixture portion in axial alignment;

the upper fixture portion and the lower fixture portion connected by at least two yoke assemblies;

wherein each yoke assembly of the at least two yoke assemblies comprises an upper yoke assembly and a lower yoke assembly connected to the upper fixture portion and lower plate portion, respectively, at a first end, and forming an articulated joint of the upper yoke assembly and the lower yoke assembly at a distal end opposite the first end; and a cutting insert connected at each distal end of the upper and lower yoke assemblies and connecting the upper and lower yoke assemblies, the cutting insert movable in a radial direction with respect to the modular device in a borehole having a diameter;

wherein the weight on bit urges the upper fixture portion and lower fixture portion towards one another thereby radially forcing the cutting insert towards the borehole surface.

15. The method of claim 14, further comprising:

connecting multiple modular devices in series within the drill borehole to increase a maximum reaction torque opposing radial rotation.

16. The method of claim 14, further comprising:

engaging the borehole with the cutting insert such that a notch is produced in the borehole when rotation is applied to the modular device.

* * * * *